United States Patent [19]

Bound

[11] Patent Number: 4,493,953

[45] Date of Patent: Jan. 15, 1985

[54] SWITCH

[75] Inventor: Damon J. F. Bound, St. Marys, Australia

[73] Assignee: F. F. Seeley Nominees Pty. Ltd., South Australia, Australia

[21] Appl. No.: 523,158

[22] Filed: Aug. 15, 1983

[30] Foreign Application Priority Data

Aug. 23, 1982 [AU] Australia ..... PF5516

[51] Int. Cl.[3] ..... H01H 19/60; H01H 3/42

[52] U.S. Cl. ..... 200/6 B; 200/6 BB; 200/153 LB; 200/303

[58] Field of Search ..... 200/5 R, 6 R, 6 B, 6 BB, 200/6 BA, 6 C, 17 R, 18, 153 L, 153 LB, 295, 303

[56] References Cited

U.S. PATENT DOCUMENTS

| | | | |
|---|---|---|---|
| 3,275,761 | 9/1966 | Yakim | 200/153 LB X |
| 3,727,021 | 4/1973 | Preis | 200/295 X |
| 4,059,738 | 11/1977 | Mongeau | 200/6 B |
| 4,132,874 | 1/1979 | Bruni et al. | 200/303 X |
| 4,133,990 | 1/1979 | Wanner et al. | 200/303 X |

FOREIGN PATENT DOCUMENTS

| | | | |
|---|---|---|---|
| 1093453 | 11/1960 | Fed. Rep. of Germany | 200/303 |
| 1301389 | 8/1969 | Fed. Rep. of Germany | 200/291 |
| 406353 | 8/1966 | Switzerland | 200/291 |

*Primary Examiner*—J. R. Scott

[57] ABSTRACT

A switch housing includes a body and a cap. The body contains terminal recesses housing respective terminal plates for fixed and movable contacts. A plurality of resilient contact fingers are mounted on one terminal plate and a single contact member is mounted to each of the remaining terminal plates. The body includes a switch shaft bearing. A switch actuating shaft is rotatably mounted in the bearing and projects outwardly from the body. The cap engages the (sic) switch shaft and terminal plates to retain the shaft and plates within the body. Latching structure on the cap and body cooperate to retain the cap and body in assembled relationship.

4 Claims, 5 Drawing Figures

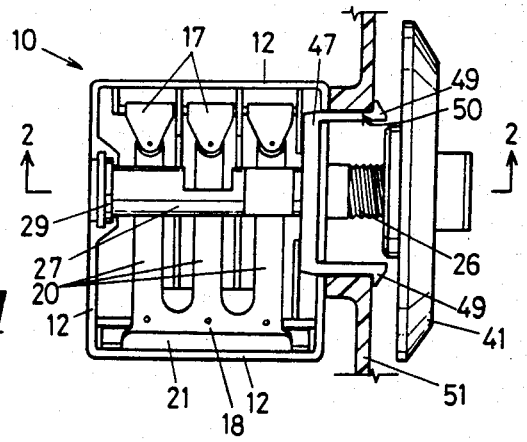
FIG 1
FIG 3
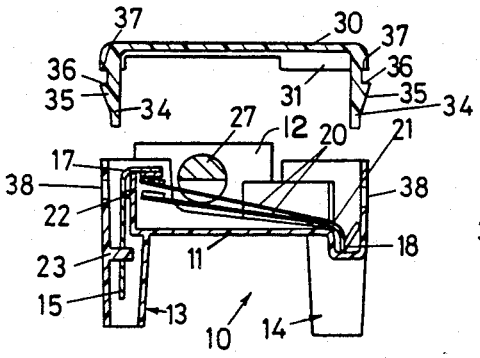
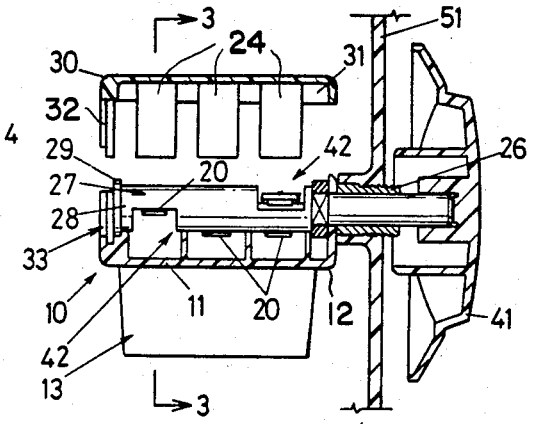
FIG 2
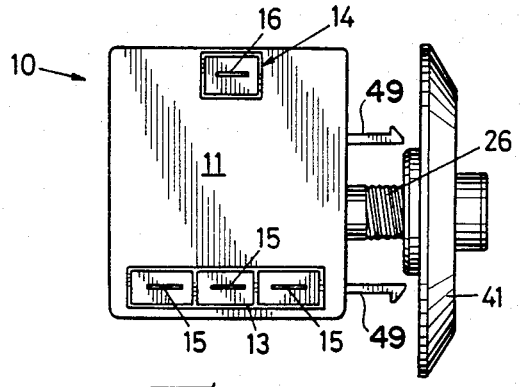
FIG 4
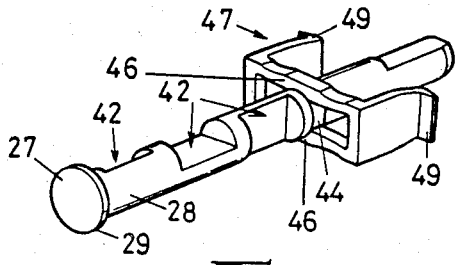
FIG 5

SWITCH

BACKGROUND OF THE INVENTION

This invention relates to a switch of the general type used for controlling the speed of a multispeed motor.

DESCRIPTION OF THE PRIOR ART

The specification of Australian Pat. No. 537109 describes a switch which has a body and a cap complementary in shape to the body which fits over the body. Some elements of the switch are housed in the body, some in the cap and some between the two.

SUMMARY OF THE INVENTION

The main object of this invention is to provide improvements whereby assembly of a switch is more easily effected and elements of the switch are more accurately located. In one embodiment of this invention there is provided a switch comprising a body and a cap, the body containing terminal recesses which themselves house respective terminal plates of fixed and moving contacts, and containing a switch shaft bearing, there being a switch actuating shaft rotatable in said bearing and projecting from the body, the cap engaging the switch shaft and terminal plates when assembled to the body, and resilient latch means co-operable between the body and cap retaining the cap to the body.

With this invention it becomes possible to assemble the switch parts all into the body of the switch, check the assembly of the switch, and then complete the assembly be merely snapping the cap into position. It further becomes possible to effect all assembly operations by snapping the elements together.

BRIEF DESCRIPTION OF THE DRAWINGS

An embodiment of the invention is described hereunder with reference to, and is illustrated in, the accompanying drawings, in which FIG. 1 is a plan view of the switch, but without the cap.

FIG. 2 is a section on line 2—2 of FIG. 1, showing the cap in a position ready to snap onto the body, FIG. 3 is a section on line 3—3 of FIG. 2, FIG. 4 is an underside view of the switch, and FIG. 5 is a perspective view of the switch shaft and its position locating spring.

DESCRIPTION OF THE PREFERRED EMBODIMENT

In this embodiment a switch body 10 comprises a base wall 11 surrounded by four side walls 12. The base wall 11 has projecting downwardly therefrom two recessed portions 13 and 14, the recesses of portion 13 containing three respective terminal plates 15, and portion 14 containing one terminal plate 16, of respective switch contact members 17 and 18.

Switch contact member 18 comprises three resilient contact fingers 20 projecting from a bridge portion 21 which is itself welded to terminal plate 16 within its terminal recess in portion 14, and being retained therein by lugs (not shown) projecting inwardly from the inner faces which define the recess of portion 14. The other downwardly projecting recessed portion 13 contains the three recesses each containing a respective terminal plate 15, and each of these is also retained in position by lugs 22 and 23 projecting inwardly from the inner recess faces which define the respective recess of portion 13, a lug 22 bearing against a face of a plate 15 near its upper end, and a lug 23 extending through an aperture in a plate 15 to retain it within its recessed portion, as seen best in FIG. 3. The depending plates 24 on the cap 30 further retain terminal plates 15 and 16 in position when the cap is snapped over the body. The front wall 12 has a forwardly projecting hollow bearing 26 in which is journalled the front end of a switch actuating shaft 27. The rear end of the switch actuating shaft is provided with a bearing portion 28 which engages in a U-shaped recess in the rear body wall. A circular flange 29 constrains shaft 27 against axial displacement.

A cap 30 is provided with depending flanges 31 which abut the upper surface of the body 10, and is also provided with a depending web 32 which enters a recess 33 at the rear of the body to close the switch body at the locality of the rear shaft bearing. In order to retain the cap in position the cap is provided with a pair of depending spigots 34 on each of two opposite sides, each depending spigot having a ramp surface 35 terminating in a shoulder 36 spaced from another horizontal shoulder 37 by a short distance. The arrangement is such that the spigots slide down the inside walls of the body and engage walls defining respective retaining apertures 38 in the side walls of the body. The cap is easily removed by depressing the spigots inwardly and lifting away, but unless the spigots are so deformed the cap remains in position and when in position retains all the elements of the switch as an assembly.

Operation of the switch is effected by rotating the actuating shaft 27 by a snap-on type knob 41. The contact fingers 20 are spring loaded upwardly, and when a transverse slot 42 aligns with a contact finger 20 (as in the left-hand side of FIG. 2), the finger 20 is free to move under its own tension and contact member 17. There are three such slots displaced 90 degrees from each other as shown in FIG. 5, so that when the knob 41 occupies any one of three corresponding positions, an electrical conductivity path is established between the terminal plate 16 and a respective one of the terminal plates 15. The fourth position is an "OFF" position. To enable an operator to clearly identify the positions, actuating shaft 27 has a short square section portion 44 located between resilient bridges 46 of a retaining member 47 which is itself constrained by walls of a slot in switch body 10 (FIG. 5). Retaining member 47 has a pair of barbs 49 which enter an aperture 50 in the mounting plate 51.

Thus assembly and installation is entirely effected by snapping together the switch parts, and snapping the assembly to its mounting plate.

Various modifications in structure and/or function may be made to the disclosed embodiments by one skilled in the art without departing from the scope of the invention as defined by the claims.

What is claimed is:

1. A switch comprising a body and a cap, and resilient latch means depending from the cap and engaging latch surfaces on the body thereby retaining the cap to the body, the body containing terminal recesses which themselves house respective terminal plates, each said terminal recess being defined by surfaces having lugs projecting therefrom into that recess, said terminal plates being engaged and retained by said lugs in their respective said recesses, said body also supporting a switch shaft bearing, there being a switch actuating shaft rotatable in said bearing and projecting from the body, a plurality of contact fingers on one of said terminal plates and respective contact members on each other said plate, said switch actuating shaft having transversely extending slots therein, each of which, when aligned with a respective said contact finger, permits movement of that contact finger into electrical contact with a said contact member, said movement being effected by resilience of that contact finger, the cap engaging the switch shaft and terminal plates when assembled to the body, and further retaining the switch shaft and terminal plates in their positions within the body.

2. A switch according to claim 1 wherein said body further comprises a retaining member having a pair of spaced apart resilient bridges, said shaft having surfaces defining a square cross-sectional shape for portion of its length, said surfaces engaging said bridges and thereby establishing four identifiable switch positions, said retaining member also comprising a pair of barbs which are engageable with surfaces of a switch mounting plate when inserted in an aperture therein.

3. A switch according to claim 1 further comprising a plurality of contact fingers on one of said terminal plates and respective singular contact members mounted on the other of said terminal plates, said switch actuating shaft transversely extending slots therein, each slot, when aligned with a respective said contact finger, permits movement of that contact finger into electrical contact with a said contact member, said movement being effected by resilience of that contact finger.

4. A switch according to claims 1, 2 or 3 wherein said resilient latch means comprises a pair of spigots depending from the cap and engageable with surfaces defining retaining apertures in respective side walls of the body.

* * * * *